US005778784A

United States Patent [19]

Barbour

[11] Patent Number: 5,778,784

[45] Date of Patent: Jul. 14, 1998

[54] FLAT BED IMPRINTER

[75] Inventor: William P. Barbour, Rocky Mount, Va.

[73] Assignee: Newbold Corporation, Rocky Mount, Va.

[21] Appl. No.: 789,535

[22] Filed: Jan. 27, 1997

[51] Int. Cl.[6] ..... B41F 3/20

[52] U.S. Cl. ..... 101/269

[58] Field of Search ..... 101/269, 348, 101/56, 146, 186, 187, 191, 192, 252, 256, 260, 264, 270, 271, 283, 284

[56] References Cited

U.S. PATENT DOCUMENTS

| | | | |
|---|---|---|---|
| 3,830,155 | 8/1974 | Pinedo | 101/269 |
| 3,954,056 | 5/1976 | Barbour . | |
| 4,270,453 | 6/1981 | Strohschneider . | |
| 4,938,132 | 7/1990 | Finn et al. | 101/269 |
| 5,193,459 | 3/1993 | Barbour . | |
| 5,385,094 | 1/1995 | Kennedy . | |

*Primary Examiner*—J. Reed Fisher

*Attorney, Agent, or Firm*—Birch, Stewart, Kolasch & Birch, LLP

[57] ABSTRACT

An imprinter apparatus selectively raises and lowers a print roll (100 or 102) over a print bed (12) for receiving a station plate and conventional credit card to produce a receipt for a credit transaction. The print rolls are freely suspended from a cross member (60) of the carriage (14) for independent pendulous movement that is restricted in one direction to provide pressure for printing and less restricted in the return direction to avoid ghosting. The trolley for the carriage includes a nylon slipper (130) which has on one surface axles for wheels (50–52) that run on the lower side of the print bed (12) and a slider (144) on the upper print bed side; on the other side of slipper (130), pins (140, 142) are provided that protrude through the steel carriage wall (62 or 64) for preventing relative movement between the trolley and the carriage (12). The various parts are designed to fit together with a minimum of secondary operations to reduce manufacturing costs.

21 Claims, 4 Drawing Sheets

FLAT BED IMPRINTER

The present invention relates to a data recorder for imprinting information from a source member such as a credit card on a recording document such as a credit card transaction form. More specifically, it relates to an imprinter apparatus which utilizes a print roll travelling within a carriage over a base plate or flat bed. In such apparatus an imprint is made by moving the carriage with the print roll forced downwardly against the recording document which overlies the source member during a print stroke and moving the carriage back during a return stroke at which time the print roll is allowed to rise to reduce ghosting.

BACKGROUND

Credit card imprinters are key elements in the field of credit buying. The market arena in which they compete is hotly contested and as a consequence the product comes under heavy price pressure. To keep costs down, it is necessary to reduce the machine to its simplist form consistent with the imprinting job reequired of it. Reprentative examples of such prior art devices are found in my earlier U.S. Pat. No. 5,193,459, and to Kennedy U.S. Pat. No. 5,385,094 and the prior art identified therein.

SUMMARY OF INVENTION

A feature of the present invention resides in a novel mounting arrangement for the print roll within the reciprocating carriage which employs a hanger that is suspended at its top from the cross member of the carriage and carries at its bottom a print roll. The print roll is allowed to swing to be above the recording document on the return stroke to avoid ghost images but is pressured against the source member and recording document by being restrained against such swinging movement on the print stroke. A preferred embodiment uses a print roll that is molded from a synthetic resin material with the print roll axle molded as an integral part thereof.

The hanger may be formed as an inverted U-shaped member wherein the cross member is formed with sockets at each end at a position above the downwardly extend arms. The print roll axles are inserted into apertures at the bottom of the arms by spreading the arms and held in position by the resilience of the arms even during the print stroke when the print pressure is applied through the hanger member. The hanger may be attached to the carriage by use of screws that are threaded through the carriage and have a lower end having a ball sized to be forced into a hanger socket of generous size to allow for a gravity induced pendulous swinging movement.

Another feature relates to the use of a slipper that is located at the inside surface of the lower ends of the side walls of the carriage. The slipper is positioned on the outside of the base plate or flat bed and translates along the length of the print stroke with the carriage movement. Each slipper carries two wheels that are adapted to run along the lower surface of the base plate in the direction of the carriage movement and a shaped surface that is adapted to slide along the upper surface of the base plate. The slipper may be easily assembled to the carriage and the combination slid over an end of the base plate. The slipper in conjunction with the carriage side walls and the side edges of the base plate act to prevent unwanted motion of the carriage and print roll during an imprint cycle.

These and other features of the invention will become more fully apparent from the claims and from the detailed description when read in conjunction with the attached drawings.

DETAILED DESCRIPTION OF PREFERRED EMBODIMENT

Figure 1:
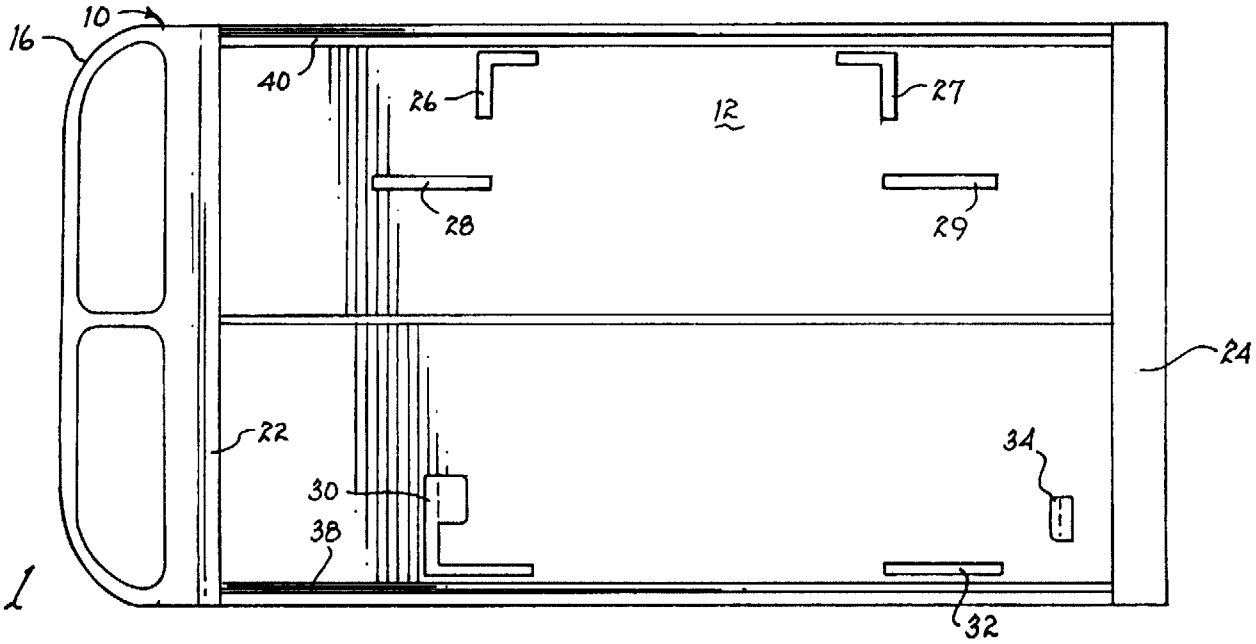
FIG. 1 is a top view of an imprinter according to the invention with the carriage removed.

An imprinter according to the present invention may include a frame 10, a print bed in the form of a flat plate 12 and a carriage 14 that is mounted for longitudinal reciprocating movement across the print bed 12. FIG. 1 shows the frame 10 and print bed 12 with the carriage 14 removed. The generally open frame 10 has a handle 16 on one end, a pair of longitudinal beams 18 and 20 and a pair of cross beams 22 and 24 at opposite ends. Tabs 26, 27, 28, 29, 30, 32 and 34 extend upwardly from the frame and fit into holes in the print bed 12 for anchoring the print bed 12 to the frame 10 and for positioning the station plate, the form set and credit card in the customary manner. Feet 36 may be provided under the four corners of frame 10.

Figure 3:
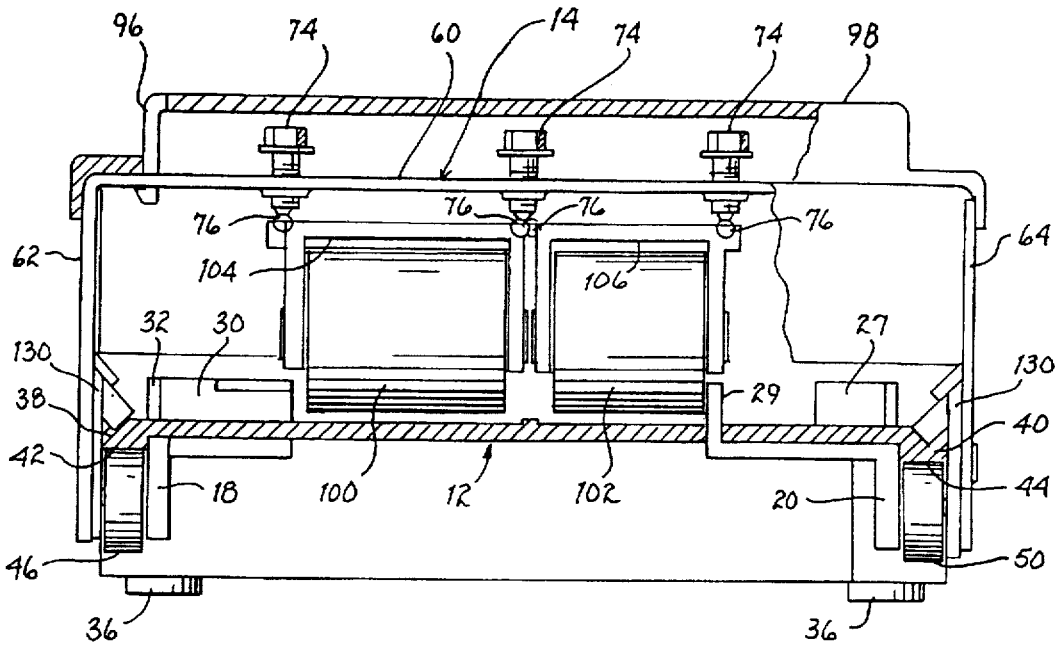
FIG. 3 is an end view in partial section of the imprinter as shown in FIG. 2.

As best shown in FIGS. 1 and 3, the print bed 12 is formed with two rail portions 38 and 40 that are outside the two longitudinal beams 18 and 20. The upper and lower surfaces of rails 38 and 40 serve to maintain the carriage 14 in a proper position with respect to the print bed 12. The lower surface 42 of rail 38 is appropriately shaped for engagement with carriage wheels 46 and 48 and the lower surface 44 of rail 40 engages wheels 50 and 52 on the other side of the print bed 12.

Figure 4:
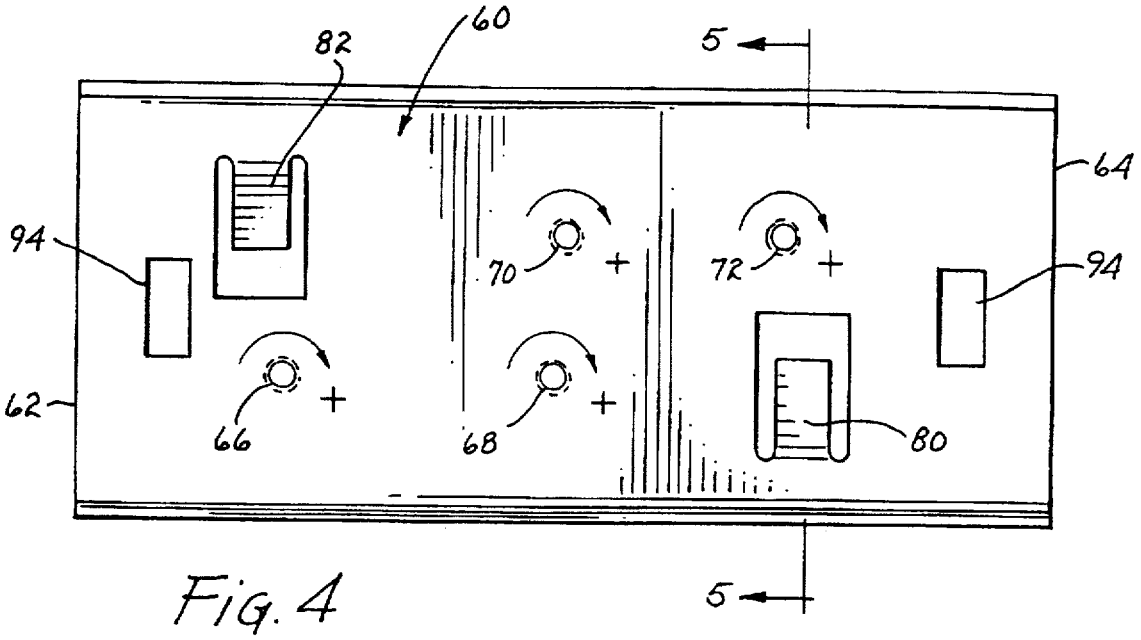
FIG. 4 is a plan view of the carriage cross member.
Figure 5:
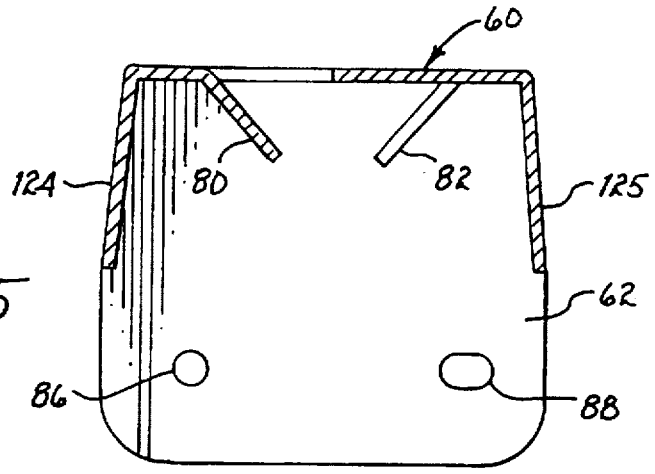
FIG. 5 is an end elevation of the carriage cross member taken along line 5—5 of FIG. 4.
Figure 6:
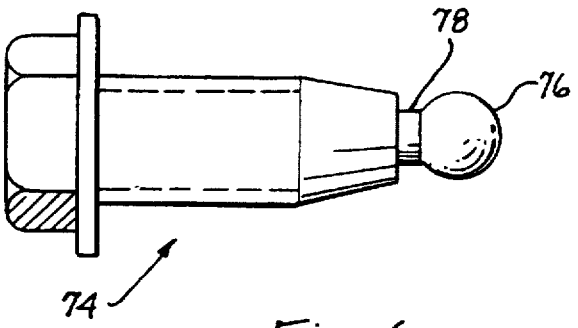
FIG. 6 is a view of the ball screw.

With reference also to FIGS. 4 and 5, the carriage 14 has a cross member 60 with down turned end panels 62 and 64 which extend to carry the wheels 46, 48, 50 and 52. The carriage thus has an inverted U-shape as illustrated in FIG. 3. The cross member 60 is formed with four threaded holes 66, 68, 70 and 72 (see FIG. 4) each adapted to carry a threaded member preferably in the form of a ball screw 74 as illustrated in FIGS. 3 and 6. Each bolt or ball screw 74 may have a ball shaped end portion 76 and a narrow neck 78. Rotation of the bolt 74 raises or lowers the ball 76 to adjust the imprinting pressure.

Carriage cross member 60 may also be formed with tabs 80 and 82 which are bent downwardly to serve as a positioning stop as will be described below. Noise absorbing material 84 may be added if a quieter operation is desired.

At the lower portion of each end panel or downwardly extending arm 62, 64 which are extensions of the length of the cross member 60, a pair of holes 86 and 88 are provided to assist in anchoring the carriage to a trolley as is described below.

Carriage cross member 60 may also be provided with openings 94 to receive prongs 96 which hold cover 98 in place on the carriage.

Each print roll 100 and 102 is suspended for independent swinging movement from the carriage cross member 60 by hangers 104 and 106. Balls 76 on the end of fasteners 74 fit in a manner such that a pendulous movement is provided. As is customary, movement of the carriage in a first direction serves as a print stroke for one print roll, e.g. 102, and at the same time, as the return stroke for the other print roll 100.

Figure 8:
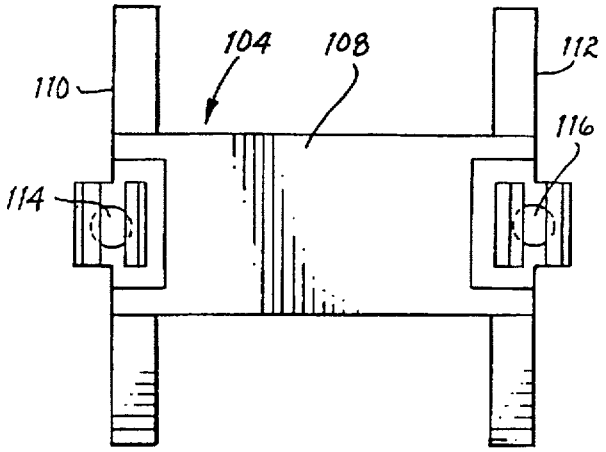
FIG. 8 is a top plan view of the hanger of FIG. 7.
Figure 9:
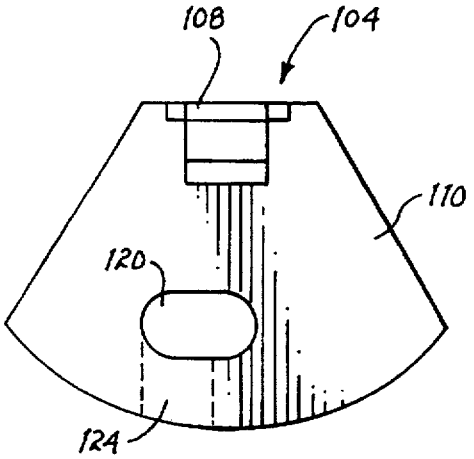
FIG. 9 is a left side view of the hanger of FIGS. 7 and 8.
Figure 7:
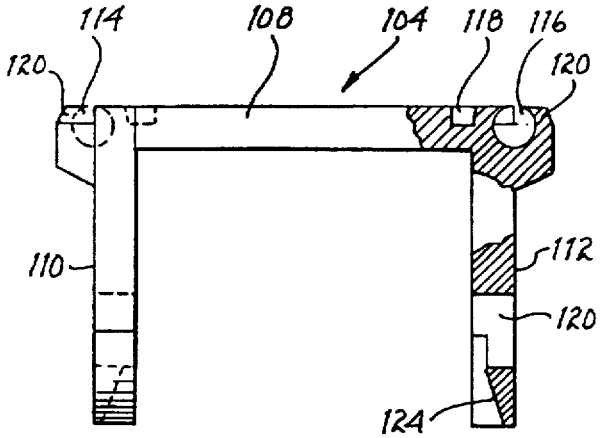
FIG. 7 is an elevation of the hanger in partial section.

With reference to FIGS. 7–9, the hangers 104 and 106 are substantially identical except for the need to accommodate print rolls of different lengths. As shown in FIG. 7, the hanger has an inverted U-shape with an upper cross member 108 being generally parallel to the carriage cross member 60. Arms 110 and 112 extend downwardly from opposite ends of cross member 104. Hanger 94 is formed from a resilient synthetic resin material such as nylon or Zytel 101. Sockets 114 and 116 are molded near opposite ends of the cross member 108. As a large compression force is applied during insertion of ball 76 into the socket 114 and also during the print stroke, I have found that the center of the socket 114 should be in substantially the same vertical plane which contains sidewall 112. Mechanically, the structure must be capable of transmitting a compressive printing force, resisting separation by a smaller tensile force as normally occurs in an imprinter and allowing movement in a pendulum like manner in a direction of the movement of the carriage.

Figure 10:
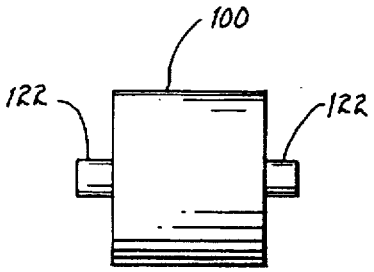
FIG. 10 is an elevation of one of the print rolls.

The lower ends of each of the arms 110 and 112 have an aperture 120 which serves as a rollable slot for a stub axle 122 on the print rolls 100 and 102. With reference to FIG. 10, the print roll axles may have a diameter of less than about 0.2 inches and a length of about 0.1 inches. Print rolls 100 and 102 are advantageously molded from a synthetic resin material having good lubricity and wear resistance such as an acetal resin so that the stub axle 122 is integral with the print roll. This is advantageous because the print roll axles 122 do not need to be contacted by any part other than the hanger arms 110 and 112 during assembly or operation.

For assembly, the stub axles 122 of print roll 100 are forced into apertures 120 at the lower ends of the arms 110 and 112. I have found that by providing a ramp 124 at the lower end of each arm, the stub axles 122 can be snapped into position thereby reducing the amount of time required for locating the print wheel axles relative to that required in most prior imprinters. No adjustments are required since the appropriate tolerances can be provided by the molding operation.

Figure 2:
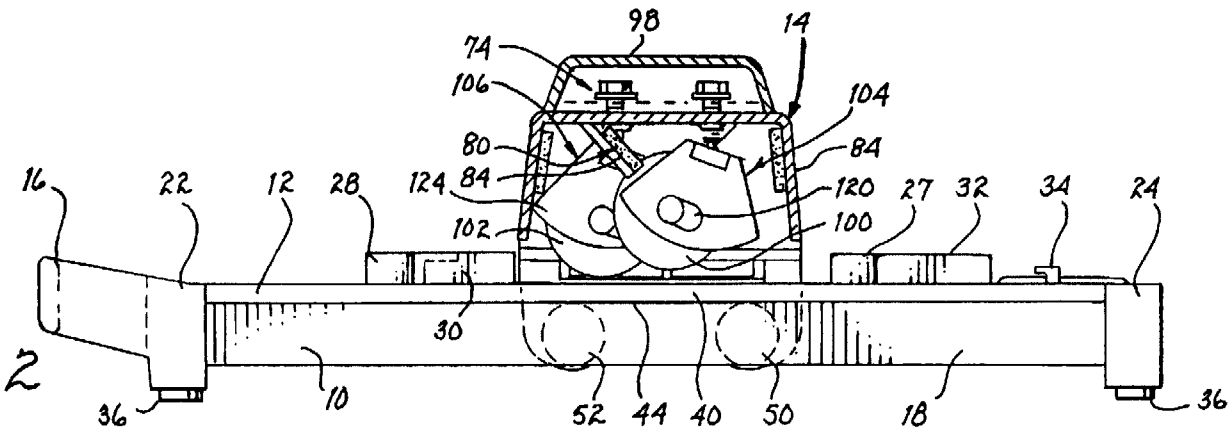
FIG. 2 is an elevation in partial section of the imprinter of FIG. 1 but with the carriage mounted on the print bed.

When a print roll 100 or 102 rolls onto a raised embossment on a metal plate or on a plastic credit card, the print roll swings rearwardly from a gravity induced vertical position. During the print stroke for print roll 102, the hanger arms 110 or 112, or both abut against a metal surface on the carriage 14 such as rear wall 124 which limits the swinging movement of the printing roll to a few degrees. The carriage front wall 125 comes into play with print roll 100 when the carriage is moved to right as viewed in FIG. 2. By raising or lowering the appropriate balls 76, the imprint pressure of roll 102 can be adequately adjusted for its print stroke, which is the return stroke for print roll 100. For roll 100, the amplitude of the swinging movement can increase through a much larger angle until the hanger arms abut against a tab 80. If ghosting should appear, it can be reduced and usually totally avoided by lengthening hole 120 to be a horizontal slot as illustrated in FIGS. 2 and 9. This allows the print roll 100 to travel upwardly further away from the underlying document and embossed plate or credit card.

The carriage has two holes 86 and 88 in each end panel 62 and 64 which are used to make fast the carriage 14 to the trolley assemblies including wheels 46, 48, 50 and 52 to the print bed 12 as illustrated in FIG. 3. To provide strength and integrity, steel or die cast metals are used in making a carriage which is the common practice.

Figure 11:
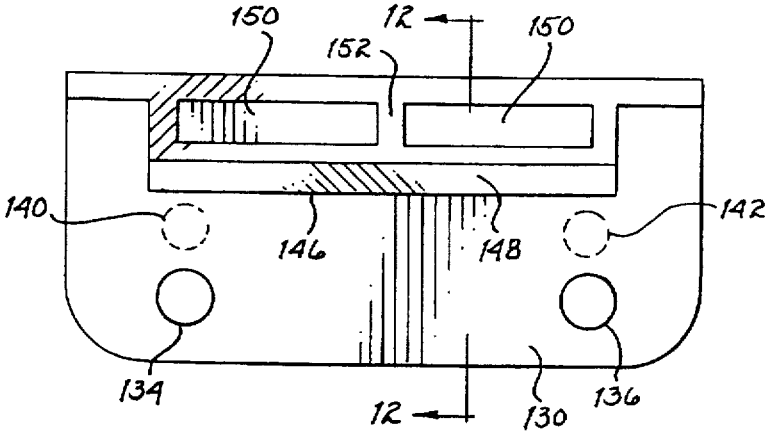
FIG. 11 is a side elevation of a slipper according to the invention.
Figure 12:
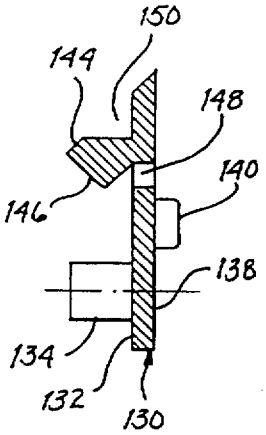
FIG. 12 is a slipper end view in section taken along lines 12—12 of FIG. 11.

An important feature from the standpoint of reduced manufacturing costs for an imprinter, resides in the use of a slipper made of a synthetic resin material such as nylon, having a thickness on the order of about 75 mils, that is sandwiched between metal print bed 12 and the steel end panel walls of the carriage 14 as shown in FIG. 3. Each slipper 130 has a front surface 132 facing the print bed 12 from which two axles 134 and 136 project and a rear surface 138 from which two pins 140 and 142 protrude as best shown in FIGS. 11 and 12. The axles 134 and 136 carry the wheels 50 and 52. The pins 140 and 142 protrude through the steel carriage wall apertures 86 and 88 (see FIG. 5) and serve to prevent rotational or lateral movement of the slipper 130 relative to the carriage 14.

A slider 144 appears as a projection that is formed on the front surface 132 of slipper 130 to be above the axles 134 and 136. The slider has a V-shaped lower surface 146 that mates with a V-shaped groove in the upper surface of rails 38 and 40 of the print bed. The slider length is generally coextensive with the distance between the underlying axles 134 and 136.

Significant reductions in manufacturing costs result from the use of the slipper 130 which eliminates the need for vertical and horizontal adjustments and for secondary assembly operations and yet provides excellent low cost bearings. The use of a print roll having an integral axle mounted in the arms of the hanger which is suspended from the carriage for swinging movement via a ball and socket attachment reduces the number of precision parts and secondary operations during manufacture.

While only a single embodiment of the invention has been described, variations and modifications may be made without departing from the spirit of the invention. All such variations and modifications which fall within the scope of the appended claims are intended to be covered thereby.

I claim:

1. In an imprinter apparatus for imprinting data from a source member onto a recording document, said apparatus comprising:

a base plate;

a print carriage having a cross member mounted for reciprocating movement in a linear direction with respect to the base plate;

a print roll supported by said carriage cross member and having an axis of rotation that is perpendicular to said linear direction, said print roll being effective to cause imprinting of said data when the carriage moves in one direction and to avoid printing of said data when the carriage moves in the opposite direction, said carriage including:

a hanger having an inverted U-shape with an upper member having a longitudinal dimension that is perpendicular to said linear direction and two downwardly extending arms at opposite ends of said upper member, said upper member being attached to the carriage by a structure that transmits a compressive printing force, resists separation by a tensile force encountered during normal operation of the imprinter and allows movement of the print roll in a pendulum like manner in a direction that is parallel to said linear direction;

said print roll being mounted at lower ends of said hanger arms for rotational movement about the print roll axis;

the pendulous movement of the hanger being restricted when the carriage moves in said one direction by engagement between one side of the hanger and the carriage cross member whereby the recording document is imprinted with said data due to a compression force applied by the print roll to a recording document properly positioned on said base plate; and the pendulous movement of the hanger being less restricted when the carriage moves in said opposite direction whereby a larger pendulous movement of the hanger arms results in a displacement of the print roll away from the source member to reduce ghosting, said apparatus further including sockets at said opposite ends of the hanger upper member to be positioned in substantial alignment with said downwardly extending arms; and a pair of screws threadedly engaged with and extending downwardly through the carriage and having on a lower free end thereof a ball shaped portion fitted into respective ones of said upper member sockets whereby rotation of the screws controls the imprint pressure.

2. Apparatus as defined in claim 1 wherein the hanger is formed from a synthetic resin material and the sockets are molded and have a shape that is essentially spherical; and said upper member includes slots which extend across openings at the top of each of said sockets to allow the ball shaped portion on the end of the screws to "snap-in" the opening of the socket for easy assembly of the print roll on the carriage.

3. Apparatus as defined in claim 1 wherein the hanger is molded from a first synthetic resin material;

the print roll has stub shaft ends molded as a unitary part from a different synthetic resin material; and said hanger arms each having an aperture for receiving the stub shaft ends of the print roll and being capable of being spread to allow insertion of the print roll therebetween.

4. Apparatus as defined in claim 3 wherein the hanger is suspended from the carriage at two laterally spaced positions that are on an upper side of the hanger upper member and the attachments each comprise a ball and socket joint that is positioned substantially vertically above the ends of the print roll.

5. Apparatus as defined in claim 4 wherein the socket is formed in the upper member of the hanger and the ball is formed on the end of a threaded metal screw, the screw has a head that is accessible for adjustment from the upper side of said carriage.

6. In an imprinter apparatus for imprinting data from a source member onto a recording document, said apparatus comprising:

a base plate;

a print carriage having a cross member mounted for reciprocating movement in a linear direction with respect to the base plate;

a print roll supported by said carriage cross member and having an axis of rotation that is perpendicular to said linear direction, said print roll being effective to cause imprinting of said data when the carriage moves in one direction and to avoid printing of said data when the carriage moves in the opposite direction, said carriage including:

a hanger having an inverted U-shape with an upper member having a longitudinal dimension that is perpendicular to said linear direction and two downwardly extending arms at opposite ends of said upper member, said upper member being attached to the carriage by a structure that transmits a compressive printing force, resists separation by a tensile force encountered during normal operation of the imprinter and allows movement of the print roll in a pendulum like manner in a direction that is parallel to said linear direction;

said print roll being mounted at lower ends of said hanger arms for rotational movement about the print roll axis;

the pendulous movement of the hanger being restricted when the carriage moves in said one direction by engagement between one side of the hanger and the carriage cross member whereby the recording document is imprinted with said data due to a compression force applied by the print roll to a recording document properly positioned on said base plate;

the pendulous movement of the hanger being less restricted when the carriage moves in said opposite direction whereby a larger pendulous movement of the hanger arms results in a displacement of the print roll away from the source member to reduce ghosting, and wherein the print roll has stub shafts at opposite ends thereof, the lower ends of the hanger arms have apertures that are elongated in a generally horizontal direction to allow the print roll stub shafts to move in a direction such that the distance between the print roll can increase to avoid ghost images on the recording document.

7. In an imprinter apparatus for imprinting data from a source member onto a recording document, said apparatus comprising:

a print bed including a source member having data in the form of raised embossments;

a print roll with stub axles molded from a synthetic resin as a unitary part to provide an axis of rotation;

a molded hanger having an inverted U-shape with a cross member and a downwardly extending arm at each end, each arm having an aperture into which a stub axle is installed;

a carriage having an inverted U-shape adapted for reciprocating movement in a longitudinal direction along said print bed and a cross member that is longer than and positioned above said hanger cross member;

said hanger being suspended from the carriage cross member for swinging movement about an axis that is parallel to said roller axis;

said carriage having a surface extending to engage the hanger to restrict the swinging motion of the print roll during the power stroke of the carriage when data is imprinted;

said hanger being free to swing with the print roll upwardly to a non-print position during the return stroke of the carriage thereby to reduce any ghost imprint; and wherein the hanger is suspended from the carriage cross member at two laterally spaced positions on an upper side of the hanger member and wherein each position includes a ball and socket joint that is positioned substantially vertically above the print roll axles.

8. Apparatus as defined in claim 7 wherein the socket is formed in an upper surface of the hanger cross member and the ball is formed on the end of a threaded metal screw that is adjustably mounted for longitudinal movement through the carriage cross member, the screw having a head that is accessible for adjustment from the upper side of said carriage.

9. Apparatus as defined in claim 8 wherein the carriage has a cross member which extends across the print bed and has side walls which depend from opposite ends of the carriage cross member, said side walls being supported on each of the opposite sides by means including a slipper, said slipper being sandwiched between an inside surface of the carriage side wall and an outside surface of the print bed and supporting two spaced wheels which engage the underside of the print bed and a slider which slides along a top surface of the print bed which overlies said spaced wheels.

10. Apparatus as defined in claim 9 wherein the lower end of the carriage has two spaced apertures; and each slipper consists of a slab of molded synthetic resin material and is formed with two hubs and the slider on one surface and on the other surface with two pins adapted to fit into said two apertures on the lower end of the carriage side wall.

11. In an imprinter apparatus for imprinting data from a source member onto a recording document, said apparatus comprising:

a print bed including a source member having data in the form of raised embossments;

a print roll with stub axles formed as a unitary part to provide an axis of rotation;

a molded hanger having an inverted U-shape with a cross member and a downwardly extending arm at each end, each arm having an aperture into which a stub axle is installed;

a carriage having an inverted U-shape adapted for reciprocating movement in a longitudinal direction along said print bed and a cross member that is longer than and positioned above said hanger cross member;

said hanger being suspended from the carriage cross member for swinging movement about an axis that is parallel to said roller axis;

said carriage having a surface extending to engage the hanger to restrict the swinging motion of the print roll during the power stroke of the carriage when data is imprinted;

said hanger being free to swing with the print roll upwardly to a non-print position during the return stroke of the carriage thereby to reduce any ghost imprint; and wherein the apertures in the hanger arms are elongated in a generally horizontal direction to have first and second end walls separated by a horizontal distance that is greater than the axle diameter to allow the print roll stub axles to be positioned against the first end wall during a print stroke and to freely roll toward the second end wall and be displaced in a direction such that during a return stroke, the distance between the print roll and the print bed can increase to reduce ghosting.

12. In an imprinter apparatus for imprinting data from a source member onto a recording document, said apparatus comprising:

a print bed including a source member having data in the form of raised embossments;

a print roll with stub axles molded from a synthetic resin as a unitary part to provide an axis of rotation;

a molded hanger having an inverted U-shape with a cross member and a downwardly extending arm at each end, each arm having an aperture into which a stub axle is installed;

a carriage having an inverted U-shape adapted for reciprocating movement in a longitudinal direction along said print bed and a cross member that is longer than and positioned above said hanger cross member;

said hanger being suspended from the carriage cross member for swinging movement about an axis that is parallel to said roller axis;

said carriage having a surface extending to engage the hanger to restrict the swinging motion of the print roll during the power stroke of the carriage when data is imprinted;

said hanger being free to swing with the print roll upwardly to a non-print position during the return stroke of the carriage thereby to reduce any ghost imprint; and wherein the carriage has a cross member which extends across the print bed and side walls which depend from opposite ends of the carriage cross member and are supported on opposite sides of the print bed by means including a slipper, said slipper being sandwiched between an inside surface of the carriage side wall and an outside surface of the print bed and supporting two spaced wheels which engage the under side of the print bed and a slider which overlies said spaced wheels and slides along a top surface of the print bed.

13. Apparatus as defined in claim 12 wherein the lower ends of the carriage side wall have two spaced apertures; and each slipper consists of a slab of molded synthetic resin material and is formed with two hubs and a slider on one surface and on the other surface with two pins adapted to fit into said two apertures on the lower end of the carriage side wall.

14. In an imprinter apparatus for imprinting data from a source member onto a recording member, said apparatus comprising:

a frame having end walls and spaced side walls extending between said end walls thereby defining a generally open interior;

a generally flat metal print bed fitted on top of the frame end walls, said print bed having side rails with at least a portion of each side of the base plate extending outside of said frame side rails;

each of said print bed rails having on a lower side a longitudinally extending wheel engaging surface and on the opposite side a vertically aligned slider engaging surface;

a print carriage includig a print roll mounted for reciprocating movement along said print bed for imprinting on a recording document data from a source on said print bed;

said carriage having a member which extends across the print bed and side walls which depend from opposite ends of the carriage cross member and are supported by the print bed rails; and a slipper located on an inside surface of the carriage side wall and sandwiched between said carriage side wall and an outside surface of said print bed, said slipper supporting two spaced wheels which engage the under side of the print bed rail and a slider, said slider overlying said wheels and being slidable along the top surface of the print bed rail thereby to clamp the carriage to the print bed rail and limit movement of the carriage to said reciprocating movement.

15. Apparatus as defined in claim 14 wherein each of said slippers has is molded from a synthetic resin material with two spaced hubs formed integrally therewith on one side of the slipper whereby the spacings between the hubs and the slider are fixed by the mold.

16. Apparatus as defined in claim 15 wherein the slipper is a slab having a slot located above the wheel hubs and below the slider so that an upper slab portion including the slider will yield upwardly in a spring like fashion to accommodate print bed rails of varying thicknesses.

17. Apparatus as defined in claim 16 wherein each slipper has a pair of spaced pins integrally formed as part of the molded slab projecting from a side facing the carriage side wall; and a pair of apertures in the respective carriage side wall for receiving said pins to transmit a translation force to the slipper that has been applied to the carriage.

18. Apparatus as defined in claim 14 wherein each slipper has a pair of spaced pins integrally formed as part of the molded slab projecting from a side facing the carriage side wall; and a pair of apertures in the respective carriage side wall for receiving said pins to transmit a translation force to the slipper that has been applied to the carriage.

19. Apparatus as defined in claim 18 including a hanger having an inverted U-shape with an upper member having two downwardly extending arms at opposite ends thereof, said upper member being attached to the carriage by a structure that transmits a compressive printing force, resists separation by a tensile force encountered during normal operation of the imprinter and allows movement of the print roll in a pendulum like manner in a direction that is parallel to said reciprocating movement;

said print roll being mounted at lower ends of said hanger arms for rotational movement about a print roll axis;

the pendulous movement of the hanger being restricted when the carriage moves in one direction by engagement between one side of the hanger and the carriage cross member whereby the recording document is imprinted with said data due to a compression force applied by the print roll to a recording document properly positioned on said print bed; and the pendulous movement of the hanger being less restricted when the carriage moves in said opposite direction whereby a larger pendulous movement of the hanger arms results in a displacement of the print roll away from the source member to reduce any ghost imprint.

20. Apparatus as defined in claim 19 further including sockets at opposite ends of the upper hanger member; and a pair of screws threadedly engaged with and extending downwardly through the carriage cross member and having on a lower free end thereof a ball shaped portion fitting into a respective one of said sockets whereby rotation of the screws controls the imprint pressure.

21. Imprinter apparatus for imprinting data from a source member onto a recording member, said apparatus comprising:

a frame having end walls and spaced side walls extending between said end walls thereby defining a generally open interior;

a generally flat metal base plate fitted on top of the frame end walls, said base plate having side rails extending outside of said frame side walls;

each of said base plate rails having on one side a longitudinally extending upper V-shaped surface and on the opposite side a vertically aligned wheel engaging surface;

a print carriage mounted for reciprocating movement along said base plate for imprinting on a recording document data from a source on said base plate;

said carriage having a cross member which extends across the base plate and side walls which depend from opposite ends of the carriage member and are supported by the base plate rails, each of said carriage side walls having a pair of apertures at a lower end thereof;

a pair of slippers formed of a slab of molded synthetic resin material that has low friction sliding properties with said base plate, each of said slippers being located at a respective lower end of each of said carriage side walls to be between one of the carriage side walls and the adjacent outer edge portion of the base plate;

a pair of wheels and a slider located on one face of each slipper and fitted on upper and lower sides of each base plate rail;

a pair of pins located on the other slipper face which mate with the side wall apertures on the carriage to fix the relative position between the slippers and the carriage thereby to limit movement of the carriage to said reciprocating movement;

a print roll supported by said carriage cross member and having an axis of rotation that is perpendicular to the direction of carriage movement, said print roll being effective to cause imprinting of said data when the carriage moves in one direction and to avoid printing of said data when the carriage moves in the opposite direction, said carriage further including:

a hanger having an inverted U-shape with an upper member having a longitudinal dimension that is parallel to and beneath the carriage cross member and two arms that extend downwardly from said upper member, said hanger being attached to the carriage cross member in a manner that allows it to be adjusted vertically and suspended from the carriage to move in a pendulum like manner in a direction that is parallel to said linear direction;

said print roll being mounted at lower ends of said hanger arms for rotational movement about the print roll axis;

one of said hanger arms having a first surface spaced from a second surface on said carriage by a distance sufficiently small so that abutment between said first and second surfaces limits the pendulous movement of the hanger arms and upward movement of the print roll away from the source member whereby the recording document is imprinted with said data when the carriage is moved in said one direction across said source member due to a compression force applied by the print roll to a recording document properly positioned on said base plate; and said hanger being suspended to allow a larger pendulous movement of the print roll in an upward direction away from the source member when the carriage is moved in said opposite direction to reduce any ghost imprint.

* * * * *